US008619504B2

(12) United States Patent
Wyssbrod

(10) Patent No.: US 8,619,504 B2
(45) Date of Patent: Dec. 31, 2013

(54) DEVICE FOR POSITIONING A BRIDGE ON A PLATE

(75) Inventor: Baptist Wyssbrod, Nidau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 77 days.

(21) Appl. No.: 13/302,037

(22) Filed: Nov. 22, 2011

(65) Prior Publication Data

US 2012/0134242 A1 May 31, 2012

(30) Foreign Application Priority Data

Nov. 25, 2010 (EP) ..... 10192498

(51) Int. Cl.
*G04B 19/00* (2006.01)

(52) U.S. Cl.
USPC ..... 368/76

(58) Field of Classification Search
USPC ..... 368/76, 88, 139, 155, 157, 297, 299, 368/300, 316, 318, 327; 29/705, 896.3
See application file for complete search history.

(56) References Cited

U.S. PATENT DOCUMENTS

| | | | | |
|---|---|---|---|---|
| 3,945,197 | A * | 3/1976 | Erard | 368/300 |
| 4,023,348 | A | 5/1977 | Giger et al. | |
| 7,057,977 | B1 * | 6/2006 | Muller | 368/88 |

FOREIGN PATENT DOCUMENTS

| | | | |
|---|---|---|---|
| CH | 133844 | A | 6/1929 |
| CH | 699 680 | A2 | 4/2010 |
| EP | 1 826 634 | A1 | 8/2007 |
| FR | 691308 | A | 10/1930 |
| FR | 2282554 | A1 | 3/1976 |

OTHER PUBLICATIONS

European Search Report dated May 26, 2011 EP 10192498.

* cited by examiner

*Primary Examiner* — Edwin A. Leon
(74) *Attorney, Agent, or Firm* — Sughrue Mion, PLLC

(57) ABSTRACT

Positioning device (1) between a bridge (2) and a plate (3). This plate (3) includes: for centering this bridge (2), a female arrangement (4) with faces (5) receiving a cylindrical smooth centering pin (6), fixed to this bridge (2) and abutting on these faces, for aligning this bridge (2) on this plate (3), an alignment housing (8) with parallel faces (9, 10) aligned on this female arrangement (4), receiving an alignment pin (11), fixed to this bridge (2). Collet (15) arranged to be fixed to a plate and including this female centering arrangement (4). Timepiece including a device (1) or collet (15) of this type. Method of assembling this bridge (2) on this plate (3) with this device (1).

20 Claims, 3 Drawing Sheets

Fig.9
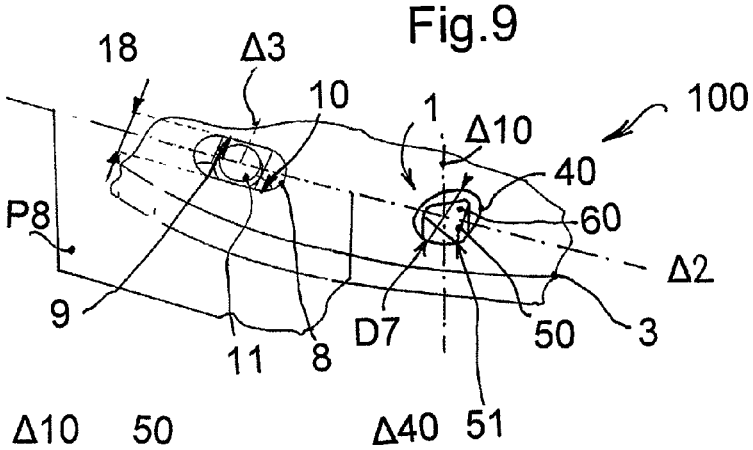
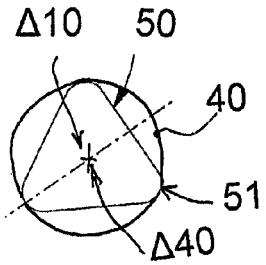
Fig.10
Fig.11
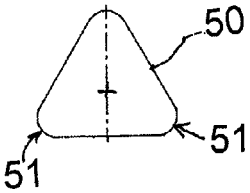
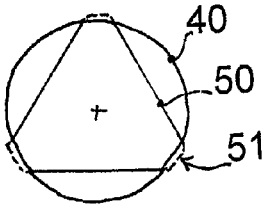
Fig.12
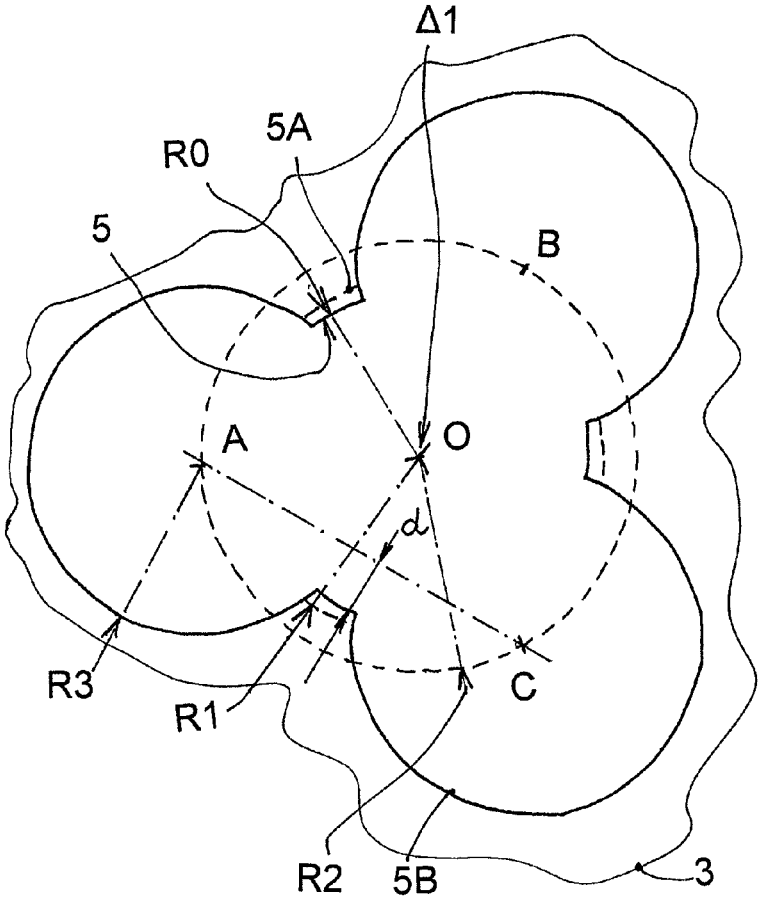
Fig.13

DEVICE FOR POSITIONING A BRIDGE ON A PLATE

This application claims priority from European Patent Application No. 10192498.3 filed Nov. 25, 2010, the entire disclosure of which is incorporated herein by reference.

FIELD OF THE INVENTION

The invention concerns a positioning device between a bridge and a plate. The invention particularly concerns a centring and alignment device between a bridge and a plate for horology. The invention still concerns a centring device.

The invention also concerns a collet, arranged to be fixed to a plate and including a centring housing for centring a pin on said plate.

The invention also concerns a timepiece incorporating at least one such device or at least one such collet.

The invention also concerns a method of mounting a bridge on a plate using this type of device.

The invention concerns the field of micro-mechanics and more specifically the field of horology.

BACKGROUND OF THE INVENTION

The technical problem is that of precisely mounting a component hereinafter called a "bridge" on a structure, hereinafter called a "plate". Precision assembly must be performed with a high level of positioning precision on the one hand and alignment precision on the other hand, generally obtained using centring pins and reference bores that cooperate with each other. Unless the bridge and plate are made simultaneously on the same fabricating means, it is difficult to obtain positioning via the cooperation between two centring pins and the corresponding bores. If the components are made separately, close tolerances must be assigned to the fabrication in order to respect the distances between two centring elements. The different thermal expansion and, more generally, deformation behaviour of the components that are assembled to each other does not facilitate high quality assemblies.

In practice, a male centring means, such as a centring pin, cooperates with a female centring means, such as a centring bore, or vice versa, and the centring thereby achieved defines a theoretical pivot axis about which the bridge can pivot relative to the corresponding plate. To ensure precision assembly, it is important to able to angularly position the bridge perfectly relative to the plate. Thus the plate generally includes a female alignment means, preferably a linear guide, which cooperates with a male guide means, generally formed by a pin, comprised in the bridge, or vice versa. Naturally there must be some radial play relative to the pivot and in the direction of linear guiding in order to compensate for the relative deformations of the bridge relative to the plate, and especially any displacement between the bridge and the plate.

The centring means on the bridge side is generally formed by a milled pivot, a pin or a screw foot, of cylindrical shape, cooperating with a bore in the plate.

The alignment means on the bridge side is also formed by a milled pivot, a pin or a screw foot, of cylindrical shape, cooperating with a hole or elongated groove in the plate.

To ensure assembly and especially removal, there is generally some play between the male centring means and the female centring means. This play compromises the positioning precision and the rigidity with which the bridge is held, in the assembly line.

However, it is known to provide a force-fit for the alignment means, so that, for example, a groove in the plate only cooperates with two short segments of the periphery of a pin fixed to the bridge. Thus, the bridge always remains removable, and a high level of alignment can be ensured because of the force-fit.

It will be noted that it is also known to perform centring with an elastic, slit, cylindrical pin, which cooperates with a cylindrical bore. However concentricity between the free state and compressed state of the pin is not guaranteed, nor is the gripping value achieved.

Assemblies with triangular pins cooperating with a smooth bore, such as those disclosed in DE Patent No. 2 034 993 in the name of Precision Industries are also known.

CH Patent No 669 680 A2 in the name of Richemont Int. S.A. discloses a device for securing a mobile component, fabricated in a fragile material, onto a support element, in particular for positioning between a bridge and a plate. This mobile component has an aperture for receiving the support element, and it includes an elastically deformable intermediate part, fixed in the aperture and including a central hole. The intermediate part redistributes part of the stresses exerted by the support element when the latter is driven into the central hole. The aperture may have faces in a polygonal cross-section, cooperating with a cylindrical pin forming the support element.

FR Patent No 2, 282 553 in the name of ETA S.A. discloses the positioning of an element on a frame using three stop members with which the element cooperates via three surfaces thereof.

SUMMARY OF THE INVENTION

It is an object of the invention to overcome this problem by proposing means for centring and aligning a bridge on a plate, capable of ensuring the required centring and alignment precision, yet allowing the removal and subsequent re-assembly of the bridge. The invention also proposes an assembly method for ensuring this precision.

The invention consists in making a centring member with abutment on a plurality of points, preferably three points.

The invention therefore concerns, on the one hand, a centring device between a bridge and a plate, and on the other hand a centring and alignment device between a bridge and a plate.

Thus, to ensure both perfect relative centring and alignment between the bridge and the plate, the invention concerns a centring and alignment device between a bridge and a plate for horology, characterized in that it includes:

- on the one hand, a centring device between said bridge and said plate, said centring device including a centring pin and a centring housing,
- said bridge carrying said centring pin which is constituted by:
  - either a centring pin with revolution symmetry about an axis of revolution;
  - or a centring pin extending along an extension axis and including male areas of support which are spaced equidistantly of said extension axis, and said plate carrying said centring housing which is respectively constituted by:

- either a ribbed female centring housing, extending in a linear direction and including female areas of support which are spaced equidistantly of said linear axis, and said ribbed female centring housing arranged to receive said centring pin fixed to said bridge, and abutting on at least three of said female areas of support, or a smooth female centring arrangement with revolution symmetry about an axis of revolution, and said female arrangement is arranged to receive said centring pin, fixed to said bridge and abutting on at least three of said male areas of support;

and on the other hand, for aligning said bridge relative to said plate:

an alignment pin carried by said bridge and including at least two shoulders, which are symmetrical relative to an axis, and an alignment housing in said plate and arranged to receive said alignment pin, said alignment housing in symmetry relative to a median plan, wherein said alignment housing is aligned in an alignment direction relative to a directional axis of said centring housing, said directional axis being respectively constituted:

either by said linear direction of said ribbed female centring housing;

or by said axis of revolution of said smooth female centring arrangement.

According to a feature of the invention, the geometrical distribution of the points of contact at said areas of support between said centring housing and said centring pin is regular relative to the circumference of said centring pin, or of said centring housing, so as to balance, relative to the axis of said centring pin, or of said centring housing respectively, the reaction forces to which said centring pin and said centring housing are respectively subjected by said centring housing and said centring pin.

Thus the distribution of the points of contact between said female arrangement and said pin is preferably regular relative to the circumference of said pin, so as to balance the reaction forces to which said pin is subjected by said female arrangement, relative to the axis of revolution of said pin.

According to feature of the invention, said areas of support are at the closest of said axis and in a same orthogonal section relative to said axis.

According to a feature of the invention, said centring housing or said centring pin has a polygonal or triangular cross-section.

According to a feature of the invention, said polygonal cross-section of said centring housing or said centring pin is regular relative to a point of a rectilinear axis of said centring housing or respectively of said centring pin.

According to a feature of the invention, the median plane is parallel to said plane of symmetry comprised in said female arrangement with faces parallel to said linear axis, or to said axis of revolution of said female revolution centring arrangement.

According to a feature of the invention, said polygonal cross-section is regular about a rectilinear axis.

According to a feature of the invention, said polygonal cross-section is triangular.

According to a feature of the invention, said polygonal cross-section is circumscribed to an inscribed circle having a smaller diameter than the diameter of a cylindrical centring cross-section of said centring pin.

According to feature of the invention, the difference between said diameters is between 2 and 15 μm.

According to a feature of the invention, said centring pin has a staged profile and, in addition to a cylindrical centring section, includes at least one insertion section having a diameter smaller than or equal to said diameter of said circle inscribed in said polygonal cross-section.

According to a feature of the invention, for aligning said bridge relative to said plate, said plate includes a rectilinear female alignment housing with parallel faces aligned in an alignment direction on a plane of symmetry of said female arrangement, parallel to said linear axis, and said bridge includes an alignment pin including at least two cylindrical shoulders, which are symmetrical relative to an axis of revolution.

According to a feature of the invention, the distance between said parallel faces is smaller than the diameter defined by said two cylindrical shoulders, and the difference between said distance and said diameter is comprised between 2 and 15 μm.

According to a feature of the invention, said centring pin has a housing for receiving a screw, arranged for cooperating with a tapping in said plate, for fixing said bridge to said plate.

According to a feature of the invention, said alignment pin includes an oblong housing for receiving a screw, arranged for cooperating with a tapping in said plate, for fixing said bridge to said plate.

According to a feature of the invention, around said centring pin, said bridge includes a recess, arranged to allow upsetting of the material of said plate when said centring pin is tight-fit assembled in said ribbed female centring housing.

The invention further concerns a centring device between a bridge and a plate, wherein, for centring said bridge on said plate, said plate includes a ribbed female centring housing extending in a linear axis and including faces in a polygonal or star-shaped cross-section orthogonally to said linear axis, and said female arrangement is arranged to receive a centring pin with revolution symmetry, fixed to said bridge and abutting on at least three of said faces, characterized in that said polygonal cross-section is circumscribed to an inscribed circle of smaller diameter than the diameter of a cylindrical centring shoulder comprised in said centring pin.

This device ensures perfect relative centring between the plate and bridge.

The invention further concerns a collet, arranged to be secured to a plate and including a ribbed female centring housing for centring a pin on said plate, characterized in that said ribbed female centring housing extends in a linear axis and includes faces in a polygonal cross-section orthogonally to said linear axis, and in that said female arrangement is arranged to receive a centring pin with revolution symmetry and abutting on at least three of said faces.

The invention further concerns a timepiece including at least one centring device of this type or a centring and alignment device of this type, or at least one collet of this type.

The invention further concerns a method of assembling a bridge on a plate using a centring device of this type or a centring and alignment device of this type, characterized in that:

said plate is machined to make said ribbed female centring housing, or said smooth female centring arrangement respectively; or said collet, or an insert with a cylindrical bore is fixed to said plate;

said plate is machined to make said rectilinear female alignment housing having parallel faces, or an insert including an alignment housing of this type is fixed to said plate;

said centring pin is positioned in said smooth female centring arrangement and driven in along said linear axis to perform a pre-centring operation, while said bridge is held at a distance from the plate, which is greater than the theoretical distance of assembly between said bridge and said plate;

said alignment pin is positioned on said female alignment housing and driven in freely in said linear axis, to perform a pre-centring operation, while said bridge is held at a distance from said plate, which is greater than the theoretical assembly distance between said bridge and said plate;

said centring pin is driven into said ribbed female centring housing while said bridge is adjusted at a distance from said plate which is equal to the theoretical distance of assembly between said bridge and said plate:

said alignment pin is driven into said female alignment housing, while said bridge is adjusted at a distance from said plate which is equal to the theoretical assembly distance between said bridge and said plate.

According to a particular feature, when said centring pin is driven into said smooth female centring arrangement, said centring shoulder is made to cooperate with at least three of said faces of said centring pin, while said bridge is adjusted at a distance from said plate which is equal to the theoretical assembly distance between said bridge and said plate.

BRIEF DESCRIPTION OF THE DRAWINGS

The invention will be become clearer upon reading the following description, with reference to the annexed drawings, in which:

FIG. 9 shows another embodiment of the invention, in a similar manner to FIG. 3.

FIG. 10 shows a schematic top view of a detail of the centring device of FIG. 9, and FIG. 11 shows the centring pin of the same.

FIG. 12 shows a variant of FIG. 11 where the centring pin is driven clamped in said ribbed female centring housing.

FIG. 13 shows a centring housing of a variant of said first embodiment, said centring housing having revolution curve surfaces arranged to cooperate with said centring pin.

FIG. 14 according to the first embodiment of FIG. 1, FIG. 15 according to the second embodiment of FIG. 9, and FIG. 16 according to the variant of FIG. 13 of the first embodiment.

DETAILED DESCRIPTION OF PREFERRED EMBODIMENTS

Figure 1:
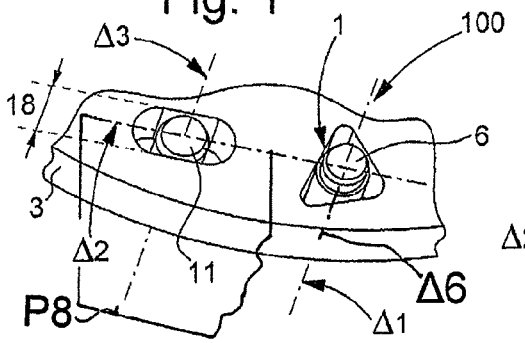
FIG. 1 shows a schematic, partial, perspective view of a detail of a timepiece including a bridge and a plate assembled to a first embodiment of a centring device including a centring pin in cooperation with a centring housing, said centring device being incorporated in a centring and alignment device according to the invention, including still an alignment pin in cooperation with an alignment housing.

The invention concerns the field of micro-mechanics and more specifically the field of horology.

The problem raised is particularly sensitive within the field of horology, where any positioning defect during assembly results, if not in damage to the components, at least in impaired operation, and an obligation to remove and then reassemble parts, either in a factory, which is already very expensive, or in after sales service, which means adding the cost of brand image damage to labour costs.

The small dimension of the components means that the centring and alignment pins cannot be moved any further away than a few millimetees, and any angular and/or positioning defect immediately has an effect on the entire movement.

Very often, the alignment adjustment member is subject to an imperfect slide fit, or is not tightened sufficiently. The actual fixing of the components to each other is conventionally achieved using screws, if possible at a distance from the centring and alignment means, which is not always possible in horology, where, conversely, it may advantageous to make use of the access available at the centring and alignment pins, for positioning the securing means. One particular constraint is the requirement for the assemblies to be detachable. Another constraint is making the height of a bridge adjustable relative to a plate, and not only the position thereof in the plane. The assemblies used must therefore be capable of such fine adjustments and be detachable.

The invention concerns a particular arrangement of the bridge and plate, which may be achieved, either by fabricating these components with finished dimensions, or by adapting or modifying existing components by securing inserts thereto. An insert called a collet will be more particularly described hereinafter, which includes a particular housing according to the invention, and allows implementation in any type of component, and may simply modify a plate, by using an already existing bridge as it is. A particular assembly method ensures the highest quality assembly, appropriate to the components. It ensures adjustability, and takes account of any handling and, in particular, transport operations between assembly stations that the pre-assembled components undergo, to ensure that any adjustments already carried out are maintained and to guarantee the integrity of the units.

Thus, the invention concerns a device 100 for centring and aligning a bridge 2 with a plate 3 for a timepiece 1000. It is clear that "device" means, either the particular arrangement of bridge 2 and plate 3, devised to allow the precise positioning thereof during assembly, or a set of components arranged to be assembled on this bridge 2 or/and this plate 3.

According to the invention, this centring and alignment device 100 includes:

on the one hand, a centring device 1 between the bridge 2 and the plate 3. This centring device 1 includes a centring pin arranged to cooperate with a centring housing. It is understood the bridge 2 or the plate 3 indifferently receive the pin or the housing, for this reason the Figures show only one of the possible alternatives.

and on the other hand an alignment pin 11 arranged to cooperate with an alignment housing 18. Here too the bridge 2 or the plate 3 receive indifferently the pin or the housing, for this reason the Figures show only one of the possible alternatives.

Figure 5:
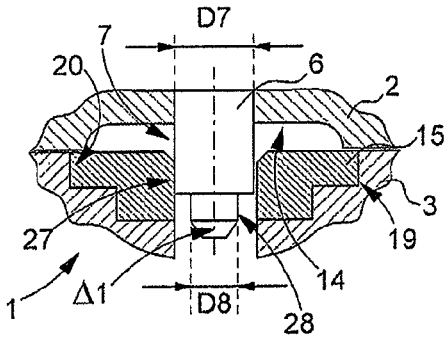

In a particular and advantageous realisation showed in FIG. 5 and exposed hereafter the plate 3 may be equipped with a collet 15 constituting the centring housing. Then in this case the centring device 1 is constituted by this collet 15 and by an adequate centring pin. Likewise the alignment housing 18 may be constituted by an inserted component, similar to this collet 15, and not shown on the Figures.

The centring device 1 for centring the bridge 2 with the plate 3 includes a centring pin shown here carried by the bridge 2. This centring pin may have different forms according to the different embodiments of the invention:

either a smooth centring pin 6, preferably smooth, with revolution symmetry about an axis of revolution Δ6 according to a first embodiment shown to FIGS. 1 to 5, 14 and 16;

or a ribbed centring pin 60 extending in a direction of insertion called extension axis Δ10 and including male areas of support 51 which are spaced equidistantly of said extension axis, particularly constituted by extremities 51 of faces 50 in a polygonal or star-shaped cross-section orthogonally to said extension axis Δ10, according to a second embodiment shown to FIGS. 9, 10, 12 and 15:

The centring and alignment device 100 still includes in complement with the centring device 1 an alignment pin 11, here shown carried by the bridge 2 and including at least two shoulders 12, 13, which are symmetrical relative to an axis of revolution Δ3, shown to the FIGS. 1, 2, 9, and 14 to 16.

The centring device 1 includes, for centring the bridge 2 with the plate 3, a centring housing 4 which is carried by the plate 3, or respectively the bridge 2, when the centring pin is carried cohesive with the bridge 2, or respectively with the plate 3, for simplification is only here described the version with the centring pin assembled with bridge 2 and centring housing 4 with plate 3. This centring housing may have different forms according to the realisation mode of the centring pin.

In the first mode shown to FIGS. 1 to 3 and 6 to 8 the bridge 2 carries a smooth centring pin 6, the centring housing 4 is realised as a ribbed female centring housing 4, extending in a linear axis Δ1 and including female areas of support 5 which are spaced equidistantly of said linear axis Δ1 arranged to be a direction of insertion. These female areas of support 5 may be in symmetry of revolution around this axis Δ1. This ribbed female centring housing 4 is arranged to receive the smooth centring pin 6 fixed to said bridge 2, and abutting on at least three of said female areas of support or faces 5. These latter may advantageously be faces 5, preferably in a polygonal or star-shaped cross-section orthogonally to said linear axis Δ1 in variants shown to FIGS. 1, 2, and 6 to 8. Or they may be curve surfaces in variants shown to FIGS. 13 and 16. These realisations are not imitative, for example the areas of support may be punctual like a ball or similar.

FIG. 13 shows an example of an economic realisation where the plate 3 is bored with three borings 5B of radius R3 which are regularly distributed, their centres A, B, C are on a circle of radius R2, and these circles are intersecting with a central boring 5 with centre o and radius R0 in a manner to let only remain three little cylindrical guideways 5, with radius R0. These guideways 5 may be overbored in a calibrated diameter of radius R1 shown as 5A. A smooth pin may be mounted in these guideways with a diametral tightening corresponding to the distance between these diameters R0 and R1. The better is each guideway since it is near from the line joining the centers of the peripherical borings of centres A, B, C, such as showed in FIG. 13 where the distance "d" is very little.

In the second embodiment shown to FIGS. 9, 10, 12 and 15, when the plate includes a ribbed centring pin 60 with male areas of support 51, the centring housing is realised as a smooth female centring arrangement 40 with revolution symmetry about an axis of revolution Δ40, and said female arrangement 4 is arranged to receive said ribbed centring pin 60 fixed to said bridge 2 and abutting on at least three of said male areas of support 51.

FIGS. 10 and 11 show a centring device according to the second embodiment with setting between a boring 40 and male cylindrical bearings 51 of the centring pin. FIG. 12 shows a variant where the centring pin is driven clamped in the centring housing 40.

According to the invention, the centring and alignment device 100 further includes, in the plate 3, for aligning bridge 2 relative to plate 3, an alignment housing 8. This alignment housing 8 is arranged to receive the alignment pin 11 fixed on the bridge 2. The previous remarks concerning the position of the pin, either on the bridge, or on the plate, remain valid.

Figure 2:
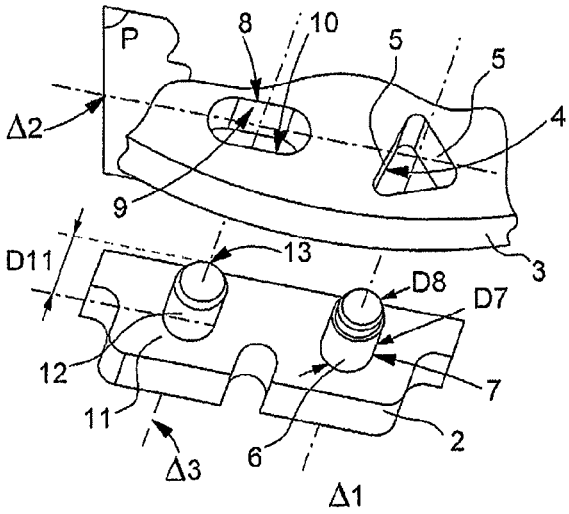
FIG. 2 shows a schematic, exploded, perspective view of the assembly of FIG. 1.

In the realisation shown to FIGS. 1, 2, and 9, the alignment housing 8 is a rectilinear, female, alignment housing whose faces 9, 10 are parallel to each other in symmetry relative to a median plane P8.

Figure 14:
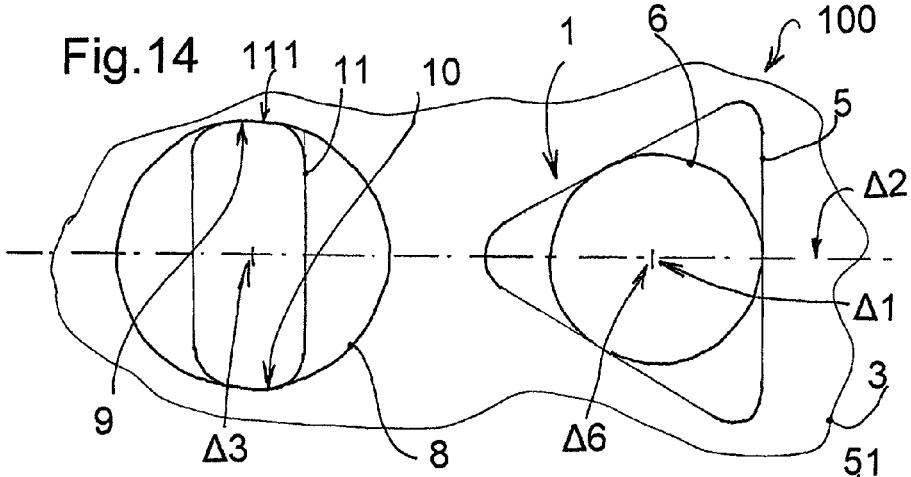
FIGS. 14 to 16 show schematic top views of three variants of alignment pins each cooperating with an alignment housing, said alignment housing here showed as a boring, said alignment pins being showed in particulars configurations of the centring device.
Figure 15:
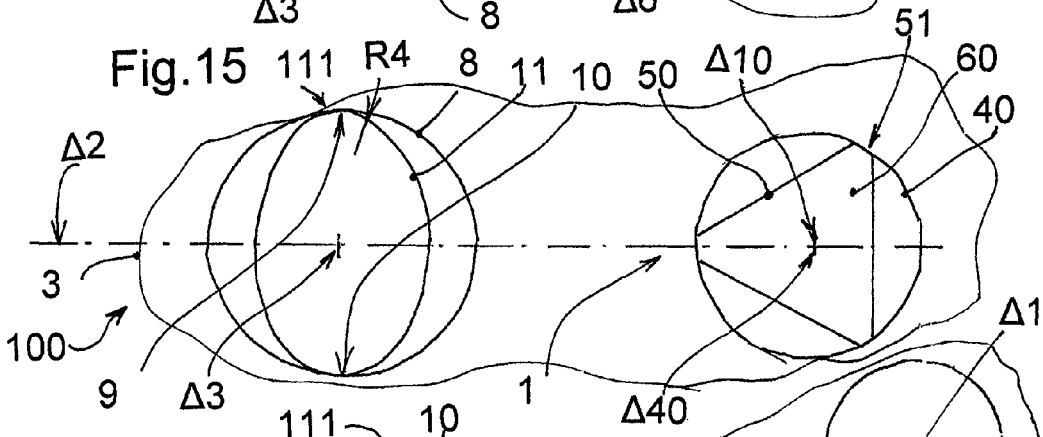
Figure 16:
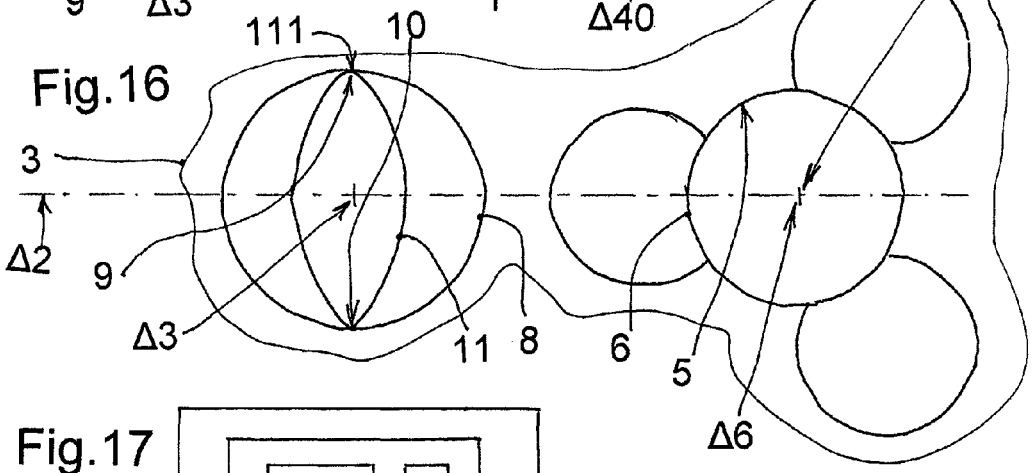
Figure 17:
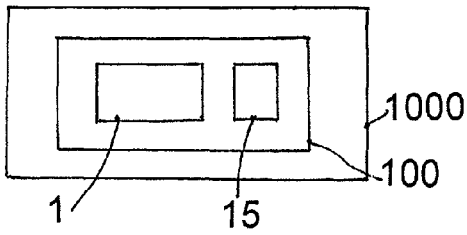
FIG. 17 shows as a block diagram a timepiece including a centring and alignment device according to the invention, including a centring device, and a collet, according to the invention.

In the realisation of FIGS. 14 to 16, the alignment housing has another form, particularly cylindrical.

This alignment housing 8 is aligned in a direction of alignment Δ2 on a directional axis of the centring housing and respectively constituted by:

either the linear axis Δ1 of the ribbed female centring housing 4 in the first embodiment, or by the axis of revolution Δ40 of smooth female centring arrangement 40 in the second embodiment.

The alignment housing 8 may still advantageously in the first embodiment, when the bridge 2 carries a smooth centring pin 6, be aligned with a plane of symmetry P of female arrangement 4 with faces parallel to linear axis Δ1.

For the simplification of the description it is here only described the configuration where the alignment pin 11 is carried cohesive by the bridge 2 and where the alignment housing 8 is installed in the plate 3, but it is naturally possible to substitute a male alignment pin to the female alignment housing and vice versa.

The distribution of the points of contact between said female arrangement and said pin is preferably regular relative to the circumference of said pin, so as to balance the reaction forces to which said pin is subjected by said female arrangement, relative to the axis of revolution of said pin.

Preferably the distribution of the contact points between the ribbed female arrangement 4 and the smooth pin 6, and between the smooth female centring arrangement 40 and the ribbed centring pin 60 respectively, is regular relative to the circumference of the smooth pin 6 and of the smooth female centring arrangement 40 respectively, so as to balance, relative to the axis of revolution Δ6 of the smooth pin 6 and to the axis Δ40 of the smooth female centring arrangement smooth 40 respectively, the reaction forces to which the smooth pin 6 and the smooth female centring arrangement smooth 40 are respectively subjected by the ribbed female arrangement 4 and the ribbed centring pin 60.

Preferably in the second embodiment the male areas of support 51 are at the closest relative to the axis Δ10 and in the same cross-section, preferably polygonal or star-shaped cross-section orthogonally to extension axis Δ10, or respectively in the first embodiment the female areas of support 5 are at the closest relative to the axis Δ1 and in the same cross-section, preferably polygonal or star-shaped cross-section orthogonally to linear axis Δ1.

Preferably as shown on the Figures the centring housing or the centring pin has a polygonal or triangular cross-section.

Preferably such a polygonal cross-section of said centring housing or said centring pin is regular relative to a point of a rectilinear axis of said centring housing or respectively of said centring pin.

FIGS. 14 to 16 show three variants of an alignment pin each cooperating with an alignment housing here shown as a boring, corresponding to particular configurations of the centring device: FIG. 14 according to the first embodiment of FIG. 1, FIG. 15 according to the second embodiment of FIG. 9, FIG. 16 with the variant of FIG. 13 of first embodiment. In the case of FIG. 14 the pin 11 is a cylindrical pin down finned by milling or grinding of two flat shoulders, and this pin 11 comes in contact only with diametral end radii which have the same value like the radius of the boring 8. FIGS. 15 and 16 show a pin with an end radius R4 which is smaller than the radius of the boring 8, with a contact already ponctual in the case of FIG. 16.

In the embodiment of FIG. 2, the centring and alignment device 100 includes on the bridge 2:

- on the one hand, a smooth centring pin 6 with revolution symmetry about an axis of revolution Δ6;
- and, on the other hand, an alignment pin 11 including at least two shoulders 12, 13, which are symmetrical relative to an axis Δ3.

And the plate 3 includes:

- on the one hand, for centring bridge 2 on plate 3, a ribbed female centring housing 4, extending in a linear axis Δ1 and including faces in a polygonal or star-shaped cross-section orthogonally to said linear axis Δ1, and said female arrangement 4 is arranged to receive said smooth centring pin 6, fixed to said bridge 2 and abutting on at least three of said faces,
- and on the other hand, for aligning bridge 2 relative to said plate 3, said alignment housing 8, which is aligned in a direction of alignment Δ2 on a plane of symmetry P comprised in said female arrangement 4 parallel to said linear axis Δ1, and said alignment housing 8 is arranged to receive said alignment pin 11, fixed to said bridge 2.

The essential point is to ensure a regular distribution of the points of contact between centring housing 4, namely female arrangement 4, and the associated smooth centring pin 6 so as to compensate for the resulting stresses and to ensure a zero result at the theoretical positioning axis of the centring pin.

Thus, the distribution of the points of contact between centring housing 4 or female arrangement 4 and pin 6 is preferably regular relative to the circumference of this one of the two elements which is of revolution, for example the pin, so as to balance the reaction forces to which pin 6 is subjected by the antagonistic component, for example centring housing 4 or female arrangement 4, relative to the axis of revolution of this one of the two elements which is of revolution, for example of pin 6.

This preferred configuration in which one of the two antagonistic components is with revolution symmetry about an axis of revolution is the less expensive to produce, and the easiest to settle. It is of course possible, even it is more expensive, to realize a female shape and a male profile with particular geometries designed such as the areas of contact imply a perfect centring form the one to the other, fore example a triangular male tenon with an hexagonal shape, or similar.

In a particular, but non-limiting embodiment, the polygonal or star shaped or similar section of ribbed centring pin 60 or ribbed female centring housing 4, as appropriate, is preferably regular about a rectilinear axis, i.e. it has at least one symmetry relative to a plane passing through said rectilinear axis, parallel to the linear axis Δ1 or Δ10, as appropriate.

In a preferred realisation the median plane P8 is parallel to a plane of symmetry comprised in the ribbed female centring housing or respectively in the centring pin.

Figure 6:
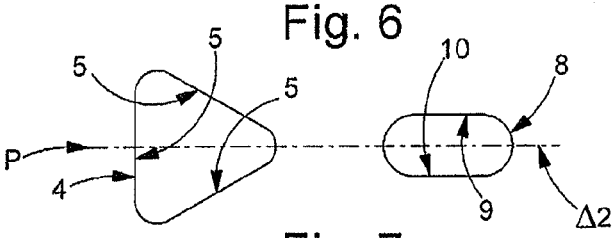
FIGS. 6 to 7 show schematic top views of two non-limiting examples of possible arrangements of a plate for implementing the invention in this first embodiment.
Figure 7:
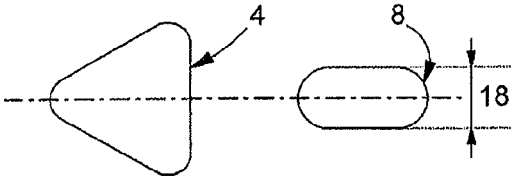

It is clear that it is not necessary to have a symmetrical alignment, as shown in FIGS. 6 and 7, although this is a convenient embodiment of the invention, particularly because this makes it easier to perform a dimension check on any machining operations carried out.

Preferably, for fabrication by stamping or similar, the section of female arrangement 4 is constant or substantially constant. However, pre-centring may be envisaged, for example in the form of triangular machining or machining of homothetic shape to that of female arrangement 4, or in the form of a tapered entry or one that radiates outwards, to facilitate pre-centring of smooth centring pin 6 when it is presented.

Preferably, the polygonal cross-section of ribbed centring pin 60 or ribbed female centring housing 4, as appropriate, is triangular. Thus the centring support occurs on three points and is perfectly isostatic. Or, in a star-shaped embodiment, there are three equally distributed shoulders.

The polygonal cross-section of ribbed centring pin 60 or ribbed female centring housing 4, as appropriate, is preferably circumscribed to an inscribed circle C1 having a diameter D1, which is smaller than the diameter D7 of a cylindrical centring shoulder 7 comprised in smooth centring pin 6, or in the centring housing.

In the first embodiment the polygonal cross-section of the ribbed female centring housing 4 is preferably circumscribed to an inscribed circle C1 having a diameter D1, which is smaller than the diameter D7 of a cylindrical centring shoulder 7 comprised in said smooth centring pin 6.

In the second embodiment the polygonal cross-section of the ribbed centring pin 60 is preferably circumscribed to an inscribed circle C1 having a diameter D1, which is greater than the diameter D7 of a cylindrical centring shoulder 7 comprised in the female centring arrangement 40.

Female arrangement 4 may be made in different ways, the most economical being either contour milling with faces tangent to the arcs of a circle, or preferably stamping with faces secant with the arcs of a circle.

The difference between diameters D7 and D1, for the application to a timepiece, is comprised between 2 and 15 μm, and is preferably kept within the range of 4 to 6 μm. Centring is thus achieved with a slight tightening, the value of which is controlled, in a tightening area 27.

Figure 4:
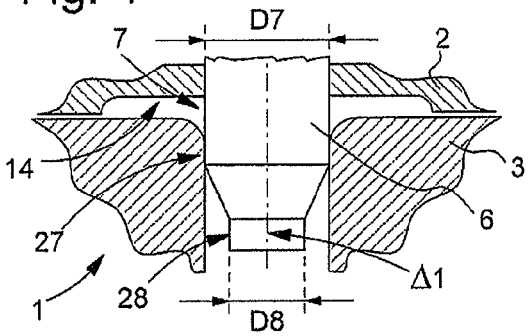
FIGS. 4 and 5 show a schematic cross-section, broken into two half-planes passing through the axis of a centring pin along cross-section AA of FIG. 3, of a bridge and a plate assembled in accordance with the invention, in two different variants, where FIG. 5 includes a collet according to the invention.

Preferably, smooth centring pin 6 has a staged profile and, in addition to a cylindrical centring shoulder 7 of diameter D7, includes at least one insertion section, or centring section respectively, having a diameter D8 smaller than or equal to said diameter D1 of the circle C1 inscribed in the polygonal cross-section of ribbed female centring housing 4. In the embodiment of FIG. 4, smooth centring pin 6 has a staged profile and, in addition to a cylindrical centring shoulder 7, of diameter D7, includes at least one insertion section 28 having a diameter D8 smaller than or equal to the diameter D1 of the circle C1 inscribed in the polygonal cross-section. Pin 6 may change progressively as seen in FIG. 4, or include several distinct shoulders, as seen in FIG. 5.

Preferably, the centring housing namely smooth female centring arrangement 40 has a staged profile and, in addition to a cylindrical centring shoulder 7 of diameter D7, includes at least one centring section having a diameter D8 greater than or equal to said diameter D2 of the circle C2 circumscribed to the polygonal cross-section of ribbed centring pin 60.

Preferably, the cross-section of the centring housing namely the ribbed female arrangement 4, or the cross-section of ribbed centring pin 60, as appropriate, is inscribed in a circumscribed circle C2 which is circumscribed to the profile of areas of support, and the maximum value of arrow F between this circumscribed circle C2 and the inscribed circle C1 to which the polygonal cross-section of the centring housing or pin is circumscribed, is such that D1/2<D1/2+F<D1/2/sin 30°.

Or still, the maximum value of arrow F between on the one hand, the polygon defining the polygonal cross-section of ribbed female centring housing 4, or ribbed centring pin 60 respectively, and on the other hand, circle C2, circumscribed to said female arrangement 4, is such that:

$$D1/2<D1/2+F<D1/2/\sin 30°.$$

Figure 3:
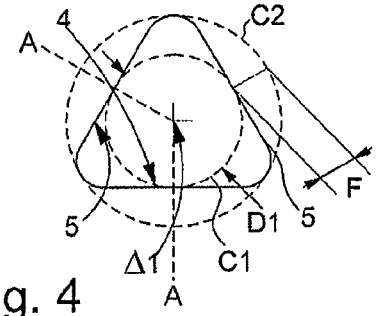
FIG. 3 shows a schematic top view of a centring housing constituted by a smooth female centring arrangement according to the invention, which is fitted with a plate like those in FIGS. 1 and 2.

In the embodiment of FIG. 3, female arrangement 4 is inscribed in a circumscribed circle C2 and the maximum value of arrow F between a face 5 and abutting on the polygon defining the polygonal cross-section, and the circle C2 circumscribed to female arrangement 4 is such that:

$$D1/2<(D1/2)+F<(D1/2)/\sin 30°.$$

Female polygonal profiles can be achieved by various technologies, in particular by stamping in the case of timepiece plates, which ensures precision, repeatability and controlled costs. It is also possible to use technologies such as hubbing or wire electroerosion, which are, however, more expensive.

A good solution for reducing production costs consists in processing the bridges and/or plates with MEMS type technologies or using the LIGA method, in particular in silicon or similar materials.

Figure 8:
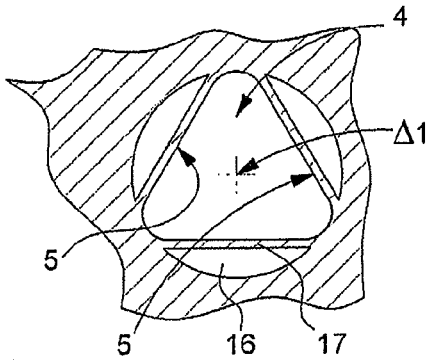
FIG. 8 shows a schematic cross-section, perpendicular to a direction of insertion, of a centring housing constituted by a smooth female centring arrangement according to the invention, made in a MEMS material, or in silicon, or in accordance with the LIGA or similar method.

In this type of processing, precision and gripping are perfectly controlled, especially since it is possible to exploit the elasticity of such materials, in particular silicon, as seen in FIG. 8, where ribbed female centring housing 4 is surrounded by peripheral recesses or chambers 16, having the effect of creating elastic partitions or lips 17. The gripping of smooth centring pin 6 can be controlled perfectly and with better repeatability than with machining operations performed in metals. In short, the force fit gripping required by the invention can be perfectly controlled, at an acceptable cost, owing to implementation of these technologies.

However, these elastic partitions or lips 17 should not be given too much elasticity. Indeed, a high quality timepiece must have excellent shock behaviour, and any lack of rigidity in the event of shocks is contrary to the desired object, which is to ensure perfect centring and alignment, and to maintain the centring and alignment over time.

In the first particular embodiment as seen in FIGS. 1, 2, 6 and 7, plate 3 includes a rectilinear female alignment housing 8 with parallel faces 9, 10 for aligning bridge 2 relative to plate 3. This housing 8 is aligned in a direction of alignment Δ2 on a plane of symmetry P of female arrangement 4, parallel to the linear axis Δ1, and bridge 2 includes an alignment pin 11, which has at least two shoulders 12, 13, which are symmetrical relative to an axis of revolution Δ3. These symmetrical shoulders 12, 13 of alignment pin 11 are preferably cylindrical.

In the second embodiment seen in FIG. 9, adopting the reverse configuration of the FIG. 3 embodiment, while remaining within the logic of the invention, this centring and alignment device 100 includes:

- on the one hand, a ribbed centring pin 60, extending in a extension axis Δ10 and including faces 50 in a polygonal or star-shaped cross-section orthogonally to said extension axis Δ10,
- and, on the other hand, an alignment pin 11 including at least two shoulders 12, 13, which are symmetrical relative to an axis of revolution Δ3.

And said plate 3 includes:

- on the one hand, for centring bridge 2 on plate 3, a smooth female centring arrangement 40 with revolution symmetry about an axis of revolution Δ40, and said female arrangement 4 is arranged to receive said ribbed centring pin 60, fixed to said bridge 2 and abutting on at least three of said faces 50;
- on the other hand, for aligning bridge 2 relative to said plate 3, a rectilinear female alignment housing 8 having faces 9, 10 that are parallel to each other, in symmetry relative to a median plane P8, wherein said alignment housing 8 is aligned in an alignment direction Δ2 on said axis of revolution Δ40 of said smooth female centring arrangement 40,
- and this alignment housing 8 is arranged to receive alignment pin 11 fixed to bridge 2.

In another variant that is not illustrated here, the female alignment housing is carried by bridge 2, whereas plate 3 then carries the alignment pin.

The distance 18 between the parallel faces 9, 10 of alignment housing 8 is preferably less than the diameter D11 defined by the two cylindrical shoulders 12 and 13, and the difference between distance 18 and diameter D11 is comprised between 2 and 15 μm, and preferably between 4 and 6 μm, so as to ensure slight gripping during assembly.

In a particular variant, smooth centring pin 6 or ribbed centring pin 60, as appropriate, may include a housing for receiving a screw arranged to cooperate with a tapping comprised in plate 3, to secure bridge 2 to plate 3.

Likewise, alignment pin 11 may include an oblong housing for receiving a screw, arranged to cooperate with a tapping comprised in plate 3 for securing bridge 2 to plate 3.

Naturally, everything set out herein may be achieved in a reverse configuration, with the male components becoming female and vice versa.

Bridge 2 preferably includes, around smooth centring pin 6, a recess 14, which is arranged to allow upsetting of the material of plate 3, and/or a shelf or shoulder at the foot of the pin, and/or a burr in the plate, when smooth centring pin 6 is assembled with gripping in ribbed female centring housing 4.

In a preferred application of the invention, plate 3 is a timepiece plate and bridge 2 is a timepiece bridge. Or, plate 3 is a timepiece bridge and bridge 2 is a timepiece plate.

The invention also concerns a device 1 for centring a bridge 2 and a plate 3. This centring device 1 can be used alone, and may include the previous described features, or the centring device 1 can be used at the core of a centring and alignment device 100 according to the invention. It is clear that "device" means the particular arrangement of bridge 2 and plate 3, devised to allow the precise positioning thereof during assembly. For centring bridge 2 on plate 3, plate 3 includes a ribbed female centring housing 4, extending in a linear axis Δ1 and including faces 5 in a polygonal or star-shaped section orthogonally to said linear axis Δ1. This female arrangement 4 is arranged to receive a smooth centring pin 6, having revolution symmetry, fixed to said bridge 2 and abutting on at least three of said faces 5.

According to the invention, this polygonal cross-section is circumscribed to an inscribed circle C2 of smaller diameter D1 than diameter D7 of a cylindrical centring shoulder 7 comprised in smooth centring pin 6.

According to a particular feature of the invention, the distribution of the points of contact between ribbed female centring housing 4 and pin 6 is regular, relative to the circumference of pin 6, so as to balance the reaction forces to which the pin is subjected by said female arrangement, relative to the axis of revolution of pin 6.

According to a particular feature of the invention, this polygonal cross-section is regular about a rectilinear axis.

According to a particular feature of the invention, this polygonal cross-section is triangular.

According to a particular feature of the invention, the difference between said diameters D7 and D1 is comprised between 2 and 15 μm.

According to a particular feature of the invention, this smooth centring pin 6 has a staged profile and, in addition to a cylindrical centring shoulder 7 of diameter D7, includes at least one insertion section whose diameter D8 is smaller than or equal to diameter D1 of the circle inscribed in this polygonal cross-section.

According to a particular feature of the invention, female arrangement 4 is inscribed in a circumscribed circle C2 and the maximum value of the arrow F between the polygon defining this polygonal cross-section and circle C2 circumscribed to female arrangement 4 is such that: $D1/2<D1/2+F<D1/2/\sin 30°$.

The invention also concerns a collet 15, which is arranged to be secured to a plate or a bridge. This collet 15 is an insert, which includes a centring housing, namely a ribbed female centring housing 4, for centring a pin on the plate or on the bridge. According to the invention, ribbed female centring housing 4 extends in a linear axis Δ1 and includes female areas of support, namely faces 5, in a polygonal cross-section orthogonally to the linear axis Δ1 and ribbed female housing 4 is arranged to receive a centring pin with revolution symmetry, abutting on at least three of these female areas of support or faces 5. It is clear that a conventional timepiece can easily be transformed by using this collet 15. Collet 15 advantageously has an external diameter 19 with close tolerance, arranged to cooperate with a bore 20 arranged on a plate 3 with very low tightening on the order of a few micrometers.

Thus the invention concerns still such a centring and alignment device 100, including at least such a collet 15 arranged to be fixed on the plate 3 and to carry the centring housing, for centring the centring pin in relation to the plate 3. The centring housing is constituted by such a ribbed female centring housing 4 which extends in a direction of a linear axis Δ1 and includes female areas of support, namely faces 5, preferably equidistant to said linear axis Δ1 in a polygonal cross-section orthogonally to the linear axis Δ1 and ribbed female housing 4 is arranged to receive a centring pin with revolution symmetry, abutting on at least three of these female areas of support or faces 5.

The invention was described here with a smooth female centring arrangement on the plate, which is the most usual case in horology, but it is clear that, naturally, the reverse configuration is also entirely possible to achieve, without departing from the invention.

The invention further concerns a timepiece 1000 including at least one centring device 1 of this type and/or a centring and alignment device 100 of this type, and/or at least one collet 15 of this type.

The invention is particularly advantageous in its application to a bridge 2 which is a pallet-cock or a barrel-bar.

The invention further concerns a method of assembling bridge 2 on plate 3 using device 1, or centring and alignment device 100, or bridge 2 on a plate 3 fitted with a collet 15 as described hereinbefore. According to this method, the following operations are performed in the following order:

- Plate 3 is machined to make ribbed female centring housing 4, or smooth female centring arrangement 40, as appropriate, or to receive a collet 15, which is then secured to plate 3, or an insert with a cylindrical bore.
- Plate 3 is then machined to make rectilinear female alignment housing 8 with parallel faces 9, 10, or an insert comprising such an alignment housing 8 is secured to the plate 3.
- Smooth centring pin 6 or ribbed centring pin 60, as appropriate, is positioned in ribbed female centring housing 4, or in smooth female centring arrangement 40 respectively, and the pin is freely driven in along a direction of a linear axis Δ1 or Δ10 respectively, to perform pre-centring, while bridge 2 is kept at a distance from plate 3, which is greater than the theoretical assembly distance between bridge 2 and plate 3. This pre-centring is useful for inserting the pivots of any wheels in the bearings of the bridge.
- Alignment pin 11 is positioned on female alignment housing 8 and driven in along the direction of linear axis Δ1 to perform pre-centring, while bridge 2 is kept at a distance from plate 3 which is greater than the theoretical assembly distance between bridge 2 and plate 3.
- Smooth centring pin 6, or ribbed centring pin 60 respectively, is driven into ribbed female centring housing 4, or smooth female centring arrangement 40 respectively, while bridge 2 is adjusted at a distance from plate 3, which is equal to the theoretical assembly distance between bridge 2 and plate 3.
- Alignment pin 11 is driven into female alignment housing 8, while bridge 2 is adjusted at a distance from plate 3 which is equal to the theoretical assembly distance between bridge 2 and plate 3.
- At least smooth centring pin 6 or alignment pin 11 is immobilised on the plate by tacking, i.e. in at least one point, using adhesive, selective laser melting, or suchlike.

In a preferred variant, when smooth centring pin 6 or ribbed centring pin 60 is driven into ribbed female centring housing 4, or smooth female centring arrangement 40 respectively, this is carried out so that centring shoulder 7 cooperates with at least three of female areas of support, namely faces 5, or respectively areas of support 51 while bridge 2 is kept at a distance from plate 3 which is equal to the theoretical assembly distance between bridge 2 and plate 3.

Optionally, bridge 2 is secured to plate 3 by at least one clamping screw.

In the preferred implementation of the invention, the smooth female centring arrangement is made in the form of a triangle, with which a cylindrical pin cooperates. Thus the contact is limited to three short segments, centring is ensured and assembly and removal are possible because of the force fit.

Thus the centring and alignment between the bridge and plate are achieved without any play and without any loss of positioning precision. Indeed, this precision is improved.

Because of the force fit of both the centring member and the alignment member, the hold of the bridge is improved, during the operation of positioning the bridge as well as the operation of screwing in said bridge on the production line. When the bridge is moved on the assembly line between these two operations, this arrangement also prevents the bridge being lifted, then coming into contact with the wheel pivots and causing damage by deforming said pivots when the bridge is subsequently secured by screws or suchlike. This arrangement also prevents the lubrication being shared with unexpected places by undesirable distribution of the lubricant.

The machining of housings with polygonal cross-sections may be made by stamping or by milling in contouring, or similar.

Centring and alignment devices according the invention realised according the preferred embodiments shown on the Figures allow many disassemblies and reassemblies without any lost of geometry, and without any variation of the functional gap or tightening, as appropriate.

The invention allows an easy transformation of existing plates or bridges, for example by transforming screw feet into circular bores for implantation of collets or of centring bushes, or for a direct utilisation as centring or alignment housings.

The invention is particularly advantageous in its application for the centring and the alignment of a pallet-cock. Usually pallet-cocks have brackets cooperating with half-moon housing in which they are pushed, but the cumulative combination between the tolerances of machining and of surface treatment of these brackets and half-moons and the value of the deformation of these brackets by assembling do not allow guarantying, neither a good centring, nor a good alignment. The invention gives an elegant and efficient solution to the problem of positioning of a pallet-cock.

The application to a barrel-bar is also opportune, particularly insofar as the invention solves the chronic problem to maintain the components of a time-piece during conveying of sub-assemblies on the automated assembly lines because of the pre-locking brought by the invention particularly with a centring device according to FIG. 12.

The solutions provided by the invention to a recurrent problem in horology, which to date has never been satisfactorily solved, go well beyond the field of horology and can easily be applied to any precision mechanical fit, such as:

positioning machining assemblies, positioning die punch elements on presses, cases with lids (arms, aeroplane equipment), seals, and suchlike.

Of course, embodiments which are possible to achieve in micro-mechanics and horology using stamping, or by implementing MEMS or LIGA technologies, must be considered differently to heavier mechanics, for which technologies based on added inserts will be implemented, including polygonal female arrangements according to the invention, which will allow the desired gripping amplitude to be controlled as desired to achieve centring.

What is claimed is:

1. A centering and alignment device between a bridge and a plate for horology, comprising:

a centering device between said bridge and said plate, said centering device including a centering pin and a centering housing, said bridge carrying said centering pin which is constituted by a smooth centering pin with revolution symmetry about an axis of revolution, and said plate carrying said centering housing which is constituted by a ribbed female centering housing, extending in a linear direction and including female areas of support which are spaced equidistantly of said linear axis, and said ribbed female centering housing arranged to receive said smooth centering pin fixed to said bridge, and abutting on at least three of said female areas of support; and for aligning said bridge relative to said plate:

an alignment pin carried by said bridge and including at least two shoulders, which are symmetrical relative to an axis, and an alignment housing in said plate and arranged to receive said alignment pin, said alignment housing in symmetry relative to a median plan, wherein said alignment housing is aligned in an alignment direction relative to a directional axis of said centering housing, said directional axis being respectively constituted by said linear direction of said ribbed female centering housing.

2. The centering and alignment device according to claim 1, wherein the geometrical distribution of the points of contact at said areas of support between said centering housing and said centering pin is regular relative to the circumference of said centering pin, so as to balance, relative to the axis of said centering pin, the reaction forces to which said centering pin and said centering housing are respectively subjected by said centering housing and said centering pin.

3. The centering and alignment device according to claim 1, wherein said female areas of support are at the closest of said linear axis and in a same orthogonal section relative to said linear axis.

4. The centering and alignment device according to claim 1, wherein said centering housing has a polygonal or triangular cross-section.

5. The centering and alignment device according to claim 4, wherein said polygonal cross-section of said centering housing is regular relative to a point of a rectilinear axis of said centering housing.

6. The centering and alignment device according to claim 4, wherein said polygonal cross-section of said ribbed female centering housing is circumscribed to an inscribed circle having a diameter, which is smaller than the diameter of a cylindrical centering shoulder comprised in said smooth centering pin, and that the difference between said diameters is comprised between 2 and 15 μm.

7. The centering and alignment device according to claim 6, wherein said smooth centering pin has a staged profile and, in addition to a cylindrical centering shoulder, includes at least one insertion section having a diameter smaller than or equal to said diameter of said circle inscribed in the polygonal cross-section of said ribbed female centering housing.

8. The centering and alignment device according to claim 4, wherein the profile of the section of said ribbed female centering housing is inscribed in a circumscribed circle to the profile of said areas of support, and the maximum value of the arrow between, on the one hand, the polygon defining said polygonal cross-section of said ribbed female centering housing, and on the other hand, said circle, circumscribed to said female arrangement, is such that: $D1/2<(D1/2)+F<(D1/2)/\sin 30°$.

9. The centering and alignment device according to claim 1, wherein said median plane is parallel to a plane of symmetry comprised in said ribbed female centering housing with faces parallel to said linear axis, and wherein said alignment housing is female and rectilinear with parallel faces parallels with said median plane.

10. The centering and alignment device according to claim 1, wherein said symmetrical shoulders of said alignment pin are cylindrical.

11. The centering and alignment device according to claim 9, wherein the distance between said parallel faces of said alignment housing is smaller than the diameter defined by said two cylindrical shoulders, and the difference between said distance and said diameter is comprised between 2 and 15 μm.

12. The centering and alignment device according to claim 1, wherein said smooth centering pin has a housing for receiving a screw, arranged for cooperating with a tapping in said plate, for fixing said bridge to said plate.

13. The centering and alignment device according to claim 1, wherein said alignment pin includes an oblong housing for receiving a screw, arranged for cooperating with a tapping in said plate, for fixing said bridge to said plate.

14. The centering and alignment device according to claim 1, wherein, around said smooth centering pin, said bridge includes a recess arranged to allow upsetting of the material of said plate when said smooth centering pin is tight-fit assembled in said ribbed female centering housing.

15. The centering and alignment device according to claim 1, wherein it includes at least such a collet arranged to be fixed on said plate and to carry said centering housing, for centering said centering pin in relation to said plate, said centering housing being constituted by a ribbed female centering housing which extends in a linear direction and includes areas of support or faces equidistant to said linear direction and which is arranged to receive a centering pin with revolution symmetry, abutting on at least three of said areas of support or faces.

16. A centering device between a bridge and a plate of horology, wherein, for centering said bridge on said plate, said centering device including a centering pin and a centering housing, said bridge carrying said centering pin which is constituted by a smooth centering pin with revolution symmetry about an axis of revolution;

and said plate carrying said centering housing which is respectively constituted by a ribbed female centering housing, extending in a linear direction and including female areas of support which are spaced equidistantly of said linear axis, and said ribbed female centering housing arranged to receive said smooth centering pin fixed to said bridge, and abutting on at least three of said female areas of support.

17. A collet for timepiece, arranged to be secured to a plate and including a centering housing for centering a pin on said plate, wherein said centering housing is a ribbed female centering housing which extends in a linear direction and includes female areas of support or faces in a polygonal cross-section orthogonally to said linear axis, and wherein said female arrangement is arranged to receive a centering pin with revolution symmetry abutting on at least three of said faces.

18. A timepiece including at least one centering and alignment device according to claim 1.

19. The timepiece according to claim 18, wherein said bridge is a pallet-cock or a barrel-bar.

20. A method of assembling a bridge on a plate using said centering and alignment device according to claim 1, comprising the following:

said plate is machined to make said ribbed female centering housing, or said collet according to claim 17, or an insert with a cylindrical bore, is fixed to said plate;

said plate is machined to make said rectilinear female alignment housing with parallel faces, or an insert comprising said alignment housing is secured to said plate;

said smooth centering pin, is positioned in said ribbed female centering housing, and said pin is driven in along said linear axis to perform a pre-centering operation while said bridge is kept at a distance from said plate, which is greater than the theoretical assembly distance between said bridge and said plate;

said alignment pin is positioned on said female alignment housing and driven in freely in said linear axis, to perform a pre-centering operation, while said bridge is kept at a distance from said plate, which is greater than the theoretical assembly distance between said bridge and said plate;

said smooth centering pin, is driven into said ribbed female centering housing, while said bridge is adjusted at a distance from said plate, which is equal to the theoretical assembly distance between said bridge and said plate;

said alignment pin is driven into said female alignment housing, while said bridge is adjusted at a distance from said plate which is equal to the theoretical assembly distance between said bridge and said plate.

* * * * *